US006722180B2

(12) United States Patent
Weschler

(10) Patent No.: US 6,722,180 B2
(45) Date of Patent: Apr. 20, 2004

(54) FRAME VEHICLE CLAMP ADAPTER

(76) Inventor: Bradley R. Weschler, 8 Longwood Dr., Huntington Station, NY (US) 11746

( * ) Notice: Subject to any disclaimer, the term of this patent is extended or adjusted under 35 U.S.C. 154(b) by 0 days.

(21) Appl. No.: 10/100,246

(22) Filed: Mar. 15, 2002

(65) Prior Publication Data

US 2003/0172710 A1 Sep. 18, 2003

(51) Int. Cl.[7] ..... B21D 1/12
(52) U.S. Cl. ..... 72/457; 72/705
(58) Field of Search ..... 248/352; 33/608; 72/457, 705; 187/216

(56) References Cited

U.S. PATENT DOCUMENTS

| | | | | |
|---|---|---|---|---|
| 2,442,604 A | | 6/1948 | Johnson et al. | |
| 3,630,066 A | | 12/1971 | Chisum | |
| 3,729,974 A | | 5/1973 | Tidwell | |
| 4,309,894 A | | 1/1982 | Connor | |
| 4,815,719 A | * | 3/1989 | Peters et al. | 72/705 |
| 5,415,023 A | * | 5/1995 | Hinson | 72/705 |
| 5,509,289 A | | 4/1996 | Narragon | |
| 5,644,946 A | | 7/1997 | Weschler | |
| 5,910,186 A | | 6/1999 | Weschler | |
| 6,182,493 B1 | | 2/2001 | Weschler | |
| 6,216,524 B1 | | 4/2001 | Weschler | |

OTHER PUBLICATIONS

Mercedes Custom Adapters 5–page brochure by Champ Frame Straightening Equip. Inc., Sun Valley, Ca. 91352, May 1986, copy in 72/705.*

* cited by examiner

*Primary Examiner*—Lowell A. Larson
(74) *Attorney, Agent, or Firm*—Galgano & Burke, LLP

(57) ABSTRACT

Frame vehicle clamp adapters which allow a frame of a frame-type vehicle to be connected to a pinch weld-type clamp. One embodiment comprises a first section having an elongated rigid protrusion extending from a base. The elongated rigid protrusion is adapted to be secured to a pinch weld clamp. A second portion of the adapter is provided with a clamp for securing a frame thereto. A preferred embodiment comprises a mechanism for adjusting the height of the adapter.

17 Claims, 5 Drawing Sheets

FRAME VEHICLE CLAMP ADAPTER

The present invention is directed to a clamp adapter, and, more particularly, to a clamp adapter which allows a frame on a frame vehicle to be securely connected to a clamp designed for attachment to a pinch weld of a unibody vehicle.

BACKGROUND

Years ago, virtually all vehicles were built upon frames having substantially tubular or channel-type construction. Some vehicles, including some SUV's and full-size cars, as well as most trucks, are still built using frames today. Equipment designed for working on frame vehicles, such as collision frame straightening equipment, are designed with clamps adapted to secure the frame to the equipment. In more modern times, most passenger vehicles are formed with unibody construction and are provided with pinch welds. Those skilled in the art will appreciate that equipment designed to work on unibody vehicles, such as unibody straightening equipment, is typically provided with clamps which, when tightened, secure the vehicle to the unibody straightening equipment. For example, the devices disclosed in Applicant's prior U.S. Pat. Nos. 5,644,946 and 5,910,186 show a unibody frame straightening device with clamps designed for attachment to a unibody. Since certain vehicles, made by the Honda/Acura companies are designed for attachment to pinch welds which extend both vertically and horizontally, the inventor of the invention disclosed herein also provided a Honda clamp as taught in U.S. Pat. Nos. 6,182,493 and 6,216,524.

From the present description, those skilled in the art will appreciate that there are times when it would be convenient for an auto body repair facility which already has equipment adapted for use on a unibody vehicle to be able to use that equipment on a vehicle comprising a frame construction. If the equipment in such person's facility only comprises clamps adapted for unibodies, the technician or shop owner is faced with the obstacle of securing the vehicle to the equipment. Doing so can present an obstacle since clamps designed for attachment to the pinch weld of a unibody vehicle are not designed to be secured to the frame of a frame vehicle.

It would, therefore, be desirable to provide an adapter for securing the frame of a frame vehicle to a pinch weld-type clamp.

SUMMARY OF THE INVENTION

The various embodiments of the present invention are designed to provide adapters which allow secure connection of a frame of a frame-type vehicle to a pinch weld-type clamp on a device such as a unibody/frame straightening device.

One embodiment of the present invention comprises a first section having an elongated rigid protrusion extending from a base. The elongated rigid protrusion is adapted to be secured in a pinch weld clamp. A second portion of the adapter is provided with a clamp for securing a frame thereto.

Another embodiment of the present invention comprises a mechanism for adjusting the height of the frame securing portion in order to provide additional height adjustability for the technician when attaching the frame of the vehicle to the piece of equipment.

These and other embodiments of the present invention are described below.

DETAILED DESCRIPTION

Figure 1:
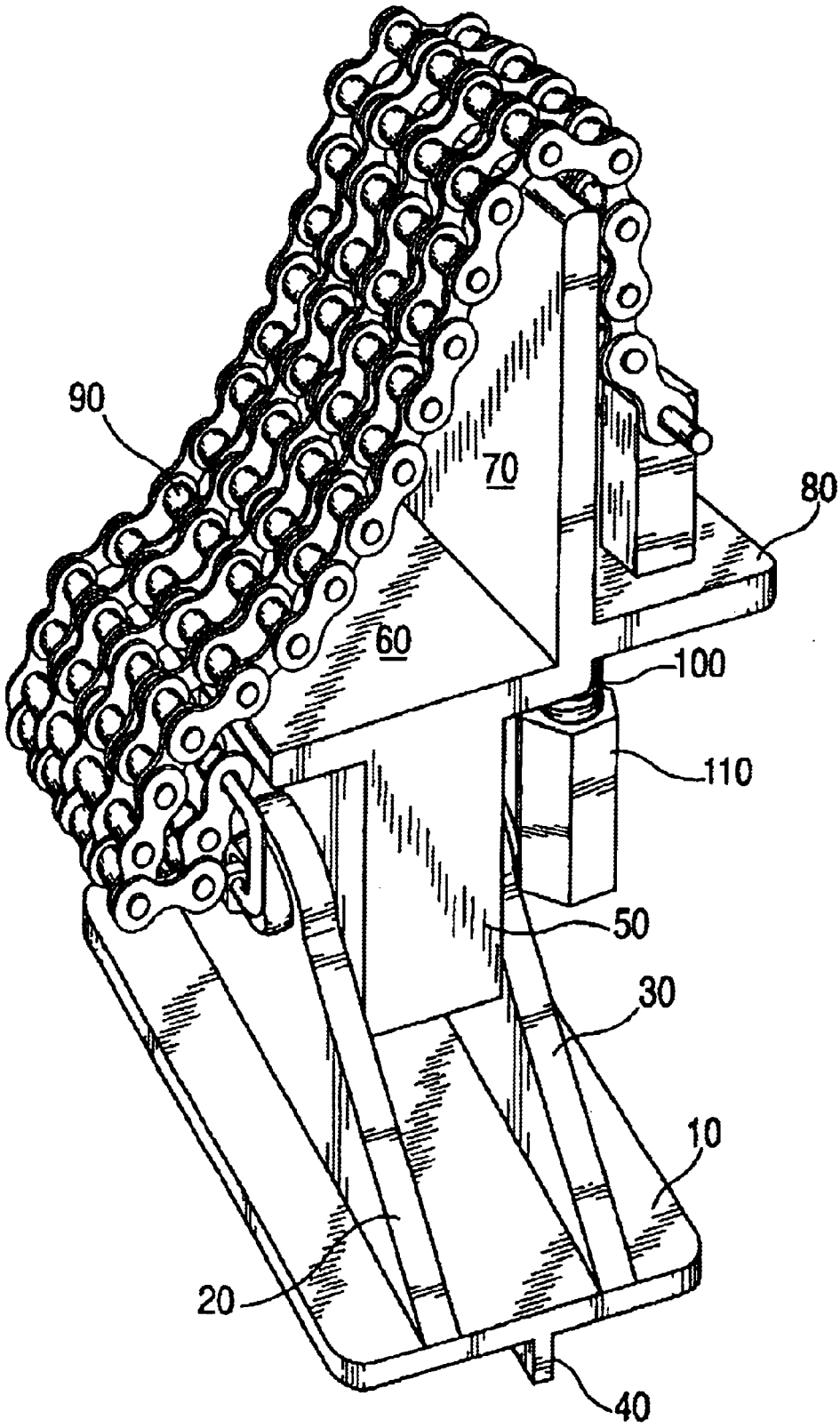
FIG. 1 is a perspective view of one embodiment of the present invention.
Figure 2:
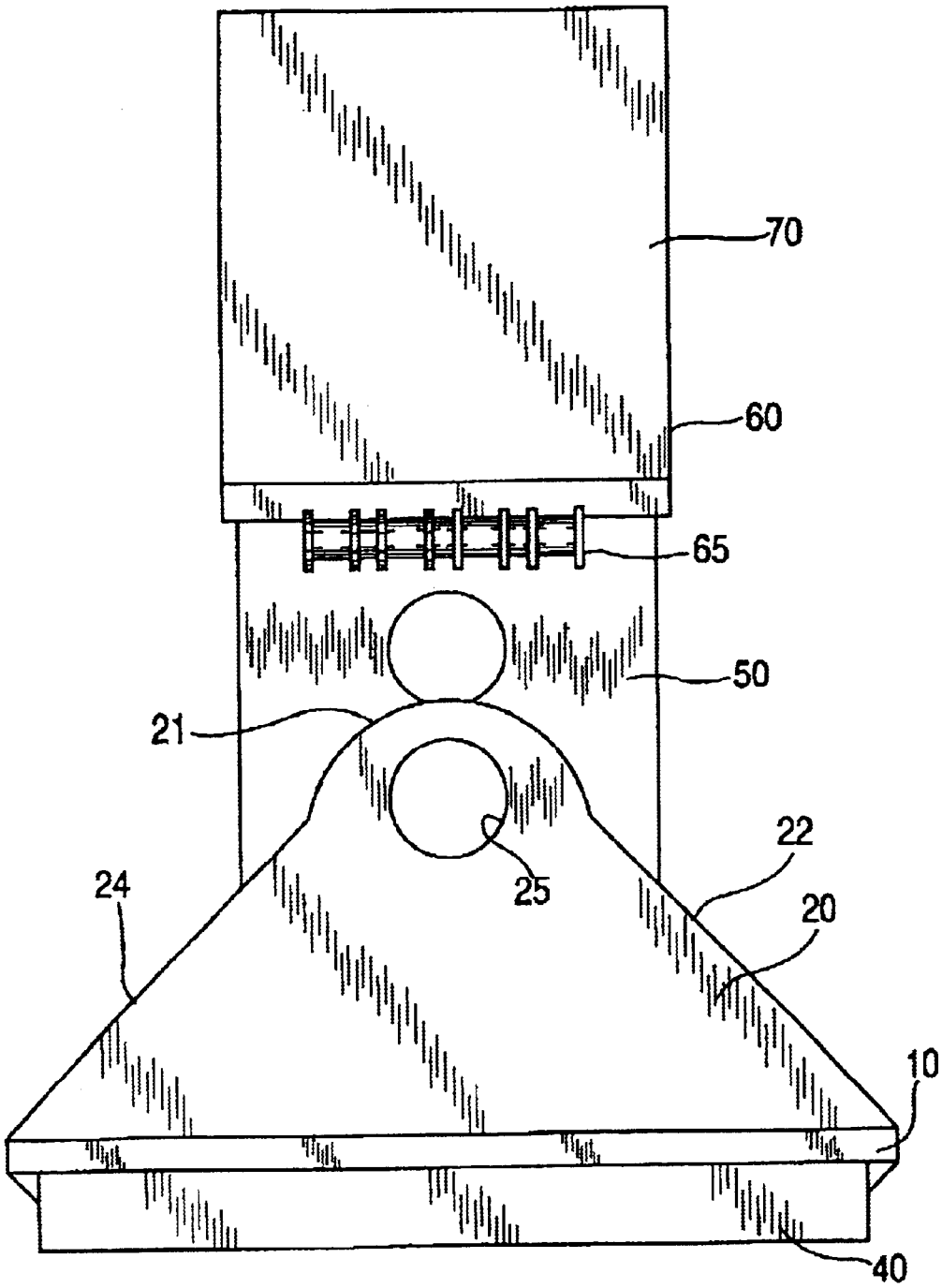
FIG. 2 is a side view of the embodiment shown in FIG. 1 without the flexible chain.
Figure 3:
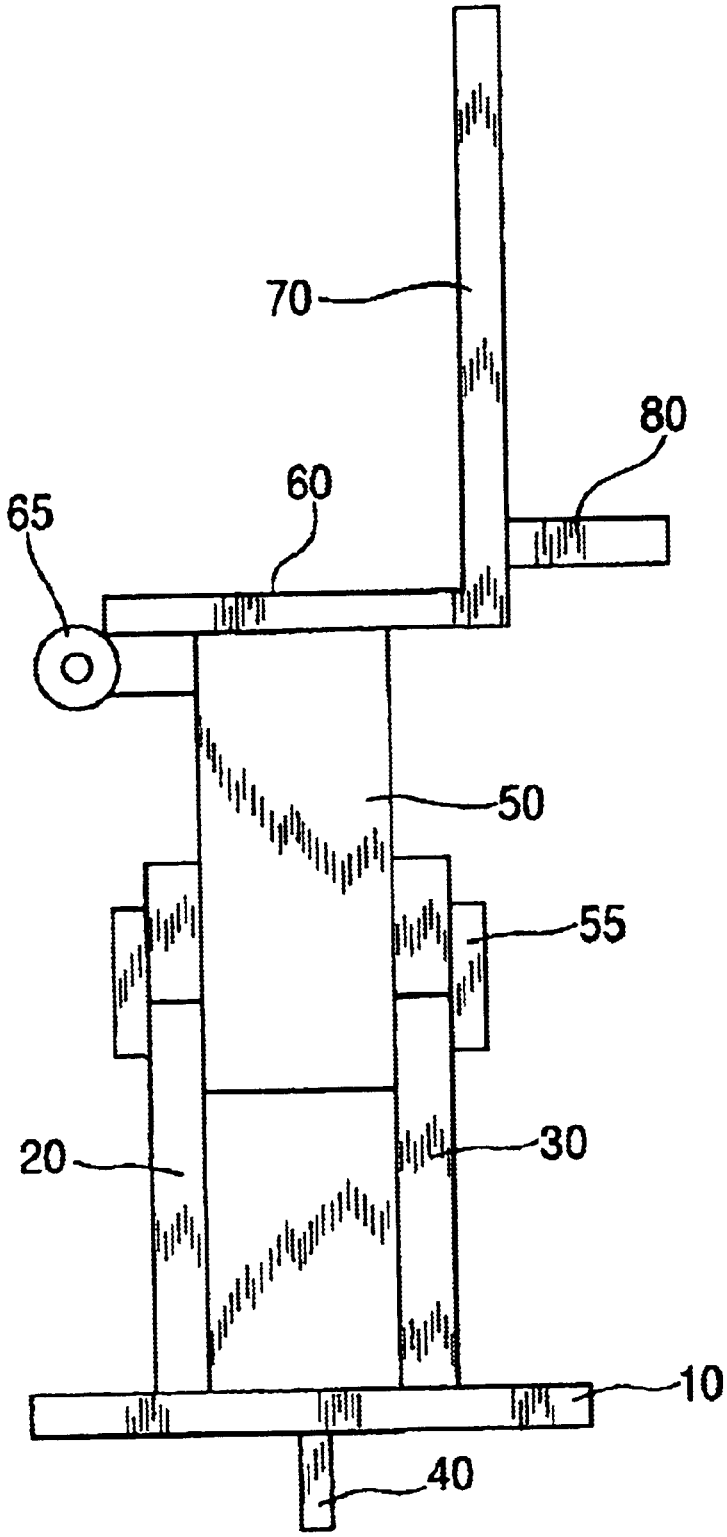
FIG. 3 is an end view of the embodiment shown in FIG. 1 without the resilient chain.

FIGS. 1 to 3 illustrate a preferred embodiment of the present invention comprising a first portion designed for attachment to a pinch weld clamp and a second portion designed for attachment to the frame of a frame vehicle. The preferred illustrated first portion comprises a base 10, two upstanding supports 20, 30, and a downwardly extending elongated protrusion 40. Protrusion 40 preferably extends for a substantial portion of the length of base 10 and is dimensioned to be securely grasped by the jaws of a pinch weld-type clamp (not shown). Those skilled in the art will appreciate that a pinch weld clamp has movable jaws designed to be tightened on the pinch weld of a vehicle. In a similar manner, the pinch weld clamps can be tightened onto protrusion 40 in order to secure the illustrated adapter to the pinch weld clamp.

The illustrated upstanding supports 20, 30 advantageously comprise sloped sides. The sloped sides 22, 24 are best illustrated in FIG. 2. The upper section 21 of the support is preferably rounded. These disclosed shapes advantageously leave room for the second portion of the adapter to pivot in a manner described in greater detail above. While the illustrated shapes are preferred, those skilled in the art will appreciate that other shapes and configurations can be used without departing from the scope of the present invention.

The second portion of the illustrated adapter comprises a connecting member 50, a two-sided, L-shaped shelf having a support shelf 60, a frame support 70 and an adjustment flange 80. In this preferred illustrated embodiment, the connecting member 50, support shelf 60, frame support 70 and adjustment flange 80 are integrally formed of a solid piece of metal, e.g., steel, for durability and strength. As best shown in FIG. 1, a resilient chain 90 is connected to the second portion proximate the outer edge of shelf 60 with a connector 65 and extends upwardly over the top of lateral frame support 70 and downwardly to adjustment flange 80. The end of chain 90 proximate adjustment flange 80 is connected to a threaded rod 100 which is connectable to a nut 110. When the second portion of the adapter is positioned on a frame, it is preferably positioned in contact with shelf support 60 and frame support 70. Resilient chain 90 is wrapped around the frame. The threaded rod 100 is then passed through a hole (not shown) in adjustment flange 80. The nut 110 is then threaded onto the threaded rod 100. By tightening nut 110, the chain 90 is tightened onto the frame of the vehicle with the frame secured between chain 90 and support shelf 60 and frame support 70.

While a flexible member such as the multi-link and multi-row chain 90 in conjunction with an L-shaped shelf illustrated in FIG. 1 is preferred, those skilled in the art will appreciate that other types of clamps can be used for attaching a frame of a vehicle to the first portion of the adapter which is attached to a pinch weld clamp.

Figure 4:
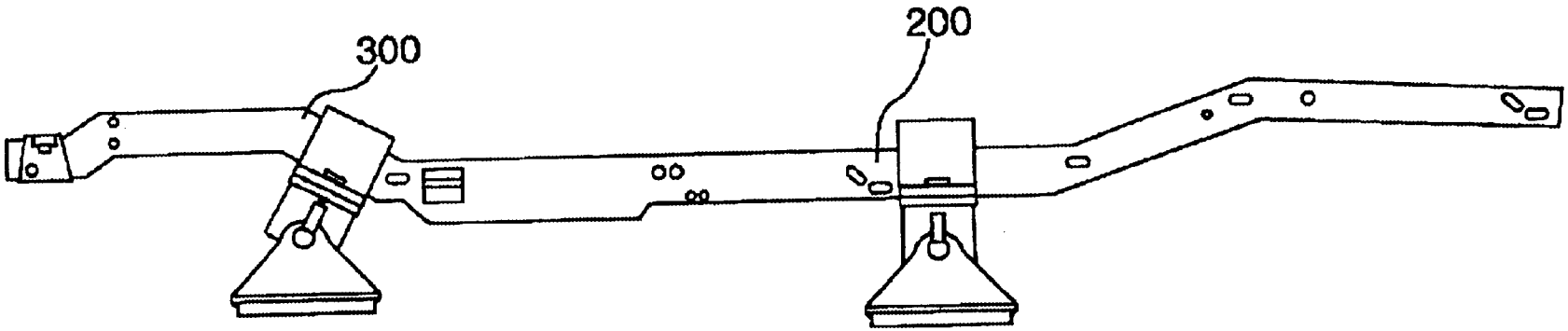
FIG. 4 illustrates two clamp adapters of the present invention positioned for attachment to a vehicle frame proximate portions of the frame which are disposed at different angles.

With reference to FIG. 4, those skilled in the art will appreciate that sections of a frame on a vehicle are not always disposed parallel to the ground or to pinch weld clamps. In this illustration, while clamp 200 is attached to a frame section which is substantially parallel to the ground, frame section 300 is disposed at an angle to the ground. In order to accommodate portions of a frame which are not parallel to the pinch weld clamp, the second portion of the adapter is advantageously pivotally connected to the first portion. In the preferred illustrated embodiment, upstanding supports 20, 30 comprise aligned holes 25 adapted to receive a pin 55. Connecting member 50 advantageously comprises a plurality of holes dimensioned similarly to the holes in the upstanding supports 20, 30. The second portion is simply attached to the first portion by locating pin 55 through the holes in the upstanding supports 20, 30 and one of the holes in the connecting member 50. By providing a plurality of holes in connecting member 50, the illustrated embodiment provides the additional benefit of making the second portion height adjustable relative to the first portion.

Figure 5:
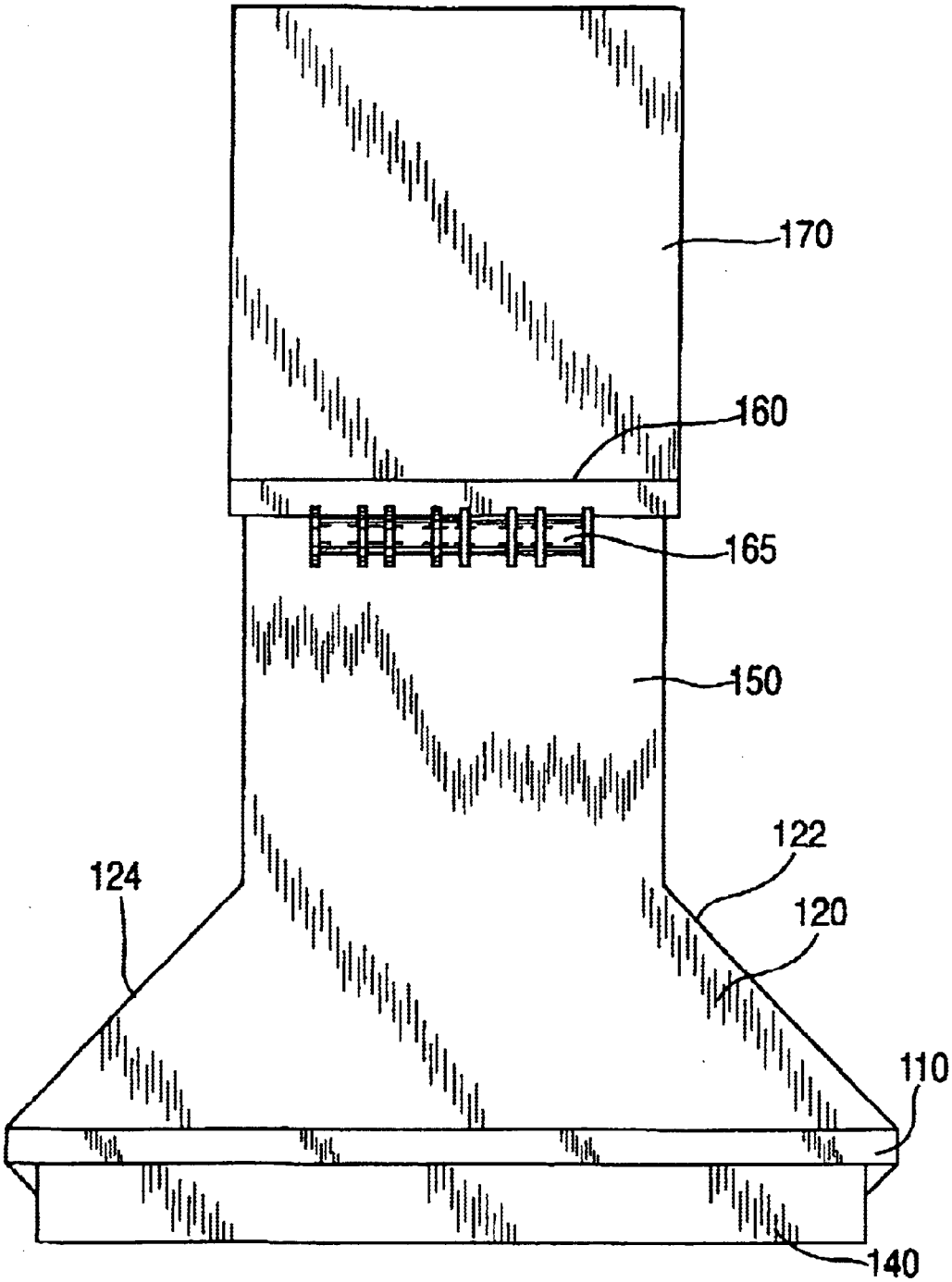
FIG. 5 illustrates another embodiment of the present invention.

An alternative embodiment to Applicant's invention is illustrated in FIG. 5. This embodiment is similar to the embodiment shown in FIGS. 1 to 3 with the exception that the second portion is integrally formed with the first portion. This embodiment of Applicant's invention works in a similar manner but without the benefit of pivotal motion between the first portion which connects to a pinch weld clamp and the second portion which connects to the frame of a frame vehicle. Similar elements are numbered with the same numbers increased by 100. The resilient chain is not illustrated in FIG. 5.

From the present description and drawings, those skilled in the art will appreciate that the adapters of the present invention advantageously provide a secure manner of connecting a frame-type vehicle to a pinch weld clamp. While several embodiments of the present invention have been illustrated, variations may be made without departing from the scope of the present invention.

I claim:

1. A clamp adapter for attaching a frame vehicle to a pinch weld clamp comprising:

a first portion comprising an elongated protrusion dimensioned to be securely received within a pinch weld clamp; and a second portion comprising means for securely connecting a frame of a frame-type vehicle to said first portion said connecting means comprising a flexible member, a rigid member, and means for adjusting the position of said flexible member whereby tightening said flexible member secures a frame between said flexible member and said rigid member.

2. A clamp adapter according to claim 1, wherein said rigid member comprises a generally L-shaped shelf which receives a frame.

3. A clamp adapter according to claim 2 wherein said first portion is pivotally connected to said second portion.

4. A clamp adapter according to claim 1 wherein said adjusting means comprises a threaded section and a nut which enable said flexible member to be tightened around a frame of a frame-type vehicle.

5. A clamp adapter according to claim 4 wherein said first portion is pivotally connected to said second portion.

6. A clamp adapter according to claim 1 wherein said flexible member comprises a chain.

7. A clamp adapter according to claim 6 wherein said chain comprises a plurality of links disposed in side-to-side arrangement.

8. A clamp adapter according to claim 6 wherein said first portion is pivotally connected to said second portion.

9. A clamp adapter according to claim 1 wherein said first portion is pivotally connected to said second portion.

10. A clamp adapter according to claim 9 further comprising means for adjusting the height of said second portion relative to said first portion.

11. A clamp adapter according to claim 10 wherein said height adjusting means comprises a plurality of holes in at least one of said first portion or said second portion.

12. A clamp adapter according to claim 1 further comprising means for adjusting the height of said second portion relative to said first portion.

13. A clamp adapter according to claim 12 wherein said height adjusting means comprises a plurality of holes in at least one of said first portion or said second portion.

14. A clamp adapter according to claim 1 wherein said first portion comprises a base, said elongated protrusion extends substantially downwardly from said base, and at least one support extends upwardly from said base.

15. A clamp adapter according to claim 14 wherein said second portion comprises a shelf comprising at least one surface adjusted to contact a frame, and a connecting member adapted for pivotal connection to said support.

16. A clamp adapter according to claim 15 wherein said connecting member comprises at least one hole, said support comprises a hole and said adapter comprises a pin dimensioned to pivotally connect said connecting member to said support.

17. A clamp adapter according to claim 15 wherein said shelf comprises at least two surfaces adapted to contact a frame.

* * * * *